US006125490A

United States Patent [19]

Riechman et al.

[11] Patent Number: 6,125,490

[45] Date of Patent: Oct. 3, 2000

[54] SYSTEM FOR CONTROLLING ENERGY AND WATER USE IN AN AUTOMATIC WASHER

[75] Inventors: Curtis E. Riechman, Baroda; John W Kurtz; Michael L. Huie, both of St. Joseph, all of Mich.

[73] Assignee: Whirlpool Corporation, Benton Harbor, Mich.

[21] Appl. No.: 09/175,016

[22] Filed: Oct. 19, 1998

[51] Int. Cl.[7] ..... D06F 33/02

[52] U.S. Cl. ..... 8/158; 68/12.02; 68/12.03; 68/12.12

[58] Field of Search ..... 8/158, 159; 68/12.02, 68/12.03, 12.12, 12.19

[56] References Cited

U.S. PATENT DOCUMENTS

| | | | |
|---|---|---|---|
| 3,093,842 | 6/1963 | Buss | 8/159 |
| 3,822,571 | 7/1974 | Waugh . | |
| 3,896,641 | 7/1975 | Worst . | |
| 4,392,891 | 7/1983 | Meyers . | |
| 4,528,709 | 7/1985 | Getz et al. | 8/158 |
| 4,643,350 | 2/1987 | DeSchaaf et al. | 68/12 |
| 4,711,103 | 12/1987 | Mori et al. . | |
| 4,784,666 | 11/1988 | Brenner et al. | 8/137 |
| 5,167,722 | 12/1992 | Pastryk et al. | 134/33 |
| 5,255,844 | 10/1993 | Miller et al. | 68/12 |

*Primary Examiner*—Frankie L. Stinson
*Attorney, Agent, or Firm*—Joel M. Van Winkle; Thomas J. Roth; Robert O. Rice

[57] ABSTRACT

An automatic washer including an automatic liquid temperature control system having a control panel which includes selector means for selecting between a normal wash cycle and a soak cycle. The control panel further includes means for selecting a desired wash water temperature in the soak cycle and means for selecting a desired wash water temperature during the normal wash cycle. The temperature selection means for the normal wash cycle is independent from the temperature selection means for the soak cycle. The temperature selection means for the normal cycle limits the maximum temperature setting during the normal wash to less than the maximum temperature setting for the soak cycle. The reduced temperature wash system is further combined with a spray rinse process. Specifically, after the wash step, the clothes load is rinsed by a plurality of recirculating spray rinse steps. During each step, a relatively small amount of water is supplied into the washer and recirculated through clothes items as the wash basket is rotated at a sufficient speed to maintain the clothes against the outer wall of the wash basket.

27 Claims, 4 Drawing Sheets

SYSTEM FOR CONTROLLING ENERGY AND WATER USE IN AN AUTOMATIC WASHER

BACKGROUND OF THE INVENTION

1. Field of the Invention

This invention relates generally to an automatic washer control system and more particularly to a system for limiting the energy and water used in the operation of an automatic washer.

2. Description of the Related Art

The amount of energy and water used by appliances, and by automatic washers in particular, is of concern to consumers, manufacturers and governmental agencies charged with conserving energy. As is well known, one of the key factors in determining an automatic washer's energy consumption is the amount of hot water the automatic washer uses during a cycle. In fact, the energy required for heating water is the dominant component in the overall amount of energy used in operating an automatic washer.

In response to concerns about energy usage, the Department of Energy (DOE) has promulgated test procedures for measuring the energy consumption of various consumer products. In 10 CFR430.23(j), specific procedures for calculating the energy consumption of an automatic washer are set forth. These procedures take into account the amount of hot water used during the normal cycle of the automatic washer. The DOE test procedures provide for the calculation of an estimated annual operating cost for an automatic washer.

The amount of hot water used in an automatic washer is dependent on the cycle selection made by the operator. In a typical automatic washer, controls are provided for allowing the operator or user to input the desired wash and rinse temperature. Depending on the type of clothes and the degree of soiling, the user may select between a full hot temperature, an intermediate or warm temperature, or a full cold inlet water fill temperature for the wash cycle. Systems for providing this selection of water fill temperatures are well known.

As can be readily understood, to minimize the amount of energy consumed by an automatic washer, it is desirable for the operator to select a wash cycle utilizing just the amount of hot water necessary to adequately wash the clothes. Ideally, the operator of an automatic washer selects a wash cycle in which the wash water temperature is less than the full hot temperature. However, since some clothes and some soil types require very hot (140° F.) water for effective cleaning, an uncontrolled fully hot water temperature option must be provided on the wash cycle controls. Unfortunately, consumers have a tendency to over select the hot water wash cycle, resulting in unnecessary and excessive energy consumption. The provision of a hot water wash cycle option also results in a relatively high annual operating cost as calculated under 10 CFR430.23(j). It would be beneficial, therefore, to limit the use of the uncontrolled, fully hot water wash cycle selection and limit the temperatures used during a normal wash cycle.

Related to the concern over energy consumption is the concern over water usage in an automatic washer. Traditional full submersion type automatic washers may use in excess of 40 gallons of water during a typical cycle. In view of the well known need to conserve water, particularly in certain communities, it is desirable to develop washers which wash clothes effectively with less water than required for traditional deep fill wash systems.

In view of the above, it can be readily appreciated that it would be an improvement in the art to develop an automatic washer which required less energy and less water than the typical, commercially available, full immersion type vertical axis washers sold in North America.

SUMMARY OF THE INVENTION

The present invention is directed to a system for limiting the wash liquid temperature during a normal wash cycle of an automatic washer to save energy. Specifically, the automatic washer of the present invention includes an automatic liquid temperature control system having a control panel which includes selector means for selecting between a normal wash cycle and a soak cycle. The control panel further includes means for selecting a desired wash water temperature in the soak cycle and means for selecting a desired wash water temperature during the normal wash cycle. The temperature selection means for the normal wash cycle is independent from the temperature selection means for the soak cycle. The temperature selection means for the normal cycle limits the maximum temperature setting during the normal wash to less than the maximum temperature setting for the soak cycle.

The present invention further combines the energy savings of a reduced temperature wash with the water savings of a spray rinse process. Specifically, the present invention utilizes a plurality of recirculating spray rinse steps. During each step, a relatively small amount of water is supplied into the washer and recirculated through clothes items as the wash basket is rotated at a sufficient speed to maintain the clothes against the outer wall of the wash basket.

DESCRIPTION OF THE PREFERRED EMBODIMENT

Figure 1:
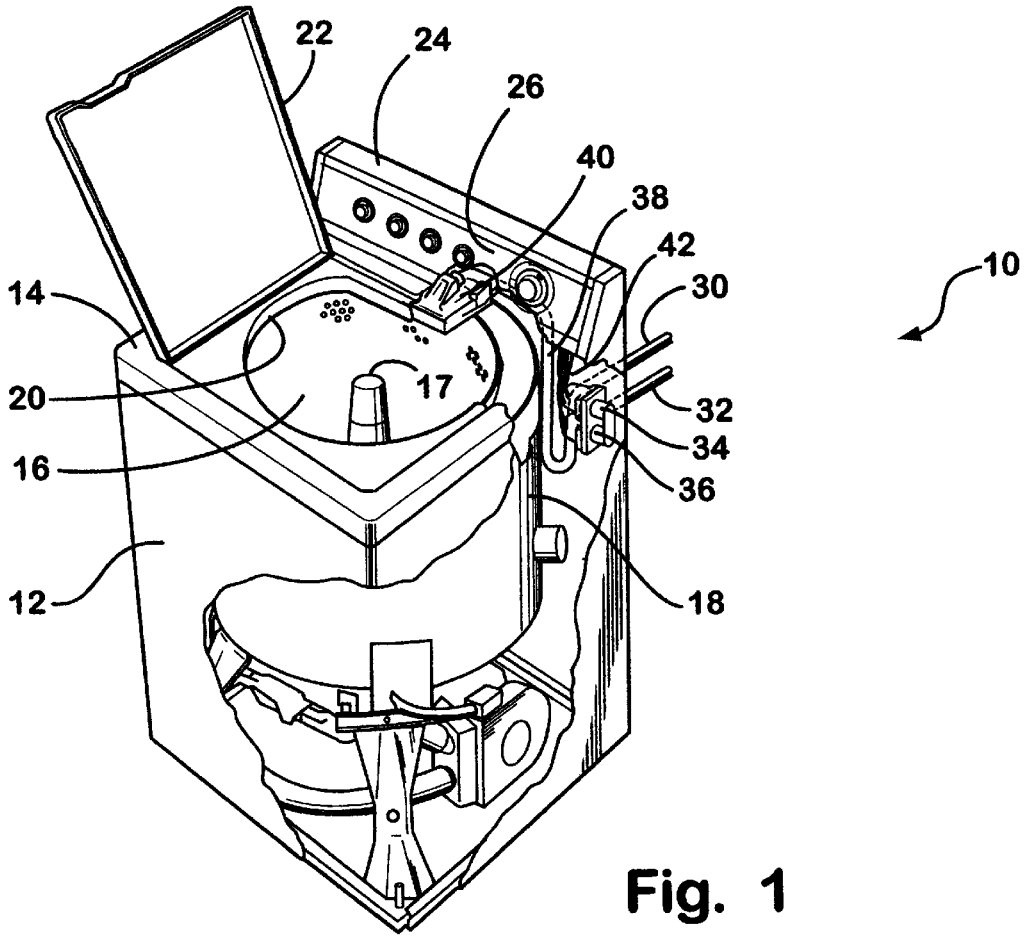
FIG. 1 is a perspective view of an automatic clothes washer including the device of the present invention.

In FIG. 1, reference numeral 10 indicates generally a washing machine of the automatic type, i.e. a machine having a pre-settable sequential control means for operating a washer through a pre-selected program of automatic washing, rinsing and drying operations. The machine 10 includes a cabinet 12 forming front and sidewalls and a top member 14. The cabinet surrounds a wash basket 16 which is rotatably supported in an imperforate wash tub 18. An agitator 17 is rotatably supported within the wash basket 16. The top member 14 includes an opening 20 for accessing the interior or treatment zone of the wash basket 16. A lid 22 is hingedly connected to the top member 14 for selective closing the access opening 20

The washing machine 10 has a console 24 having a control panel 26. The control panel 26 has a plurality of control input means as shown in greater detail in FIG. 2.

Water is supplied to the imperforate wash tub 18 by hot and cold water supply lines 30 and 32, respectively, which are connected to respective hot and cold mixing valves 34 and 36. The water valves 34 and 36 are connected to a water fill conduit 38 which leads to a water inlet and sensor housing 40 mounted adjacent to the upper edge of the imperforate tub 18. The hot and cold valves 34 and 36 are controlled through leads 42 connected thereto by electrical circuit (not shown) contained within the console 24.

Figure 2:
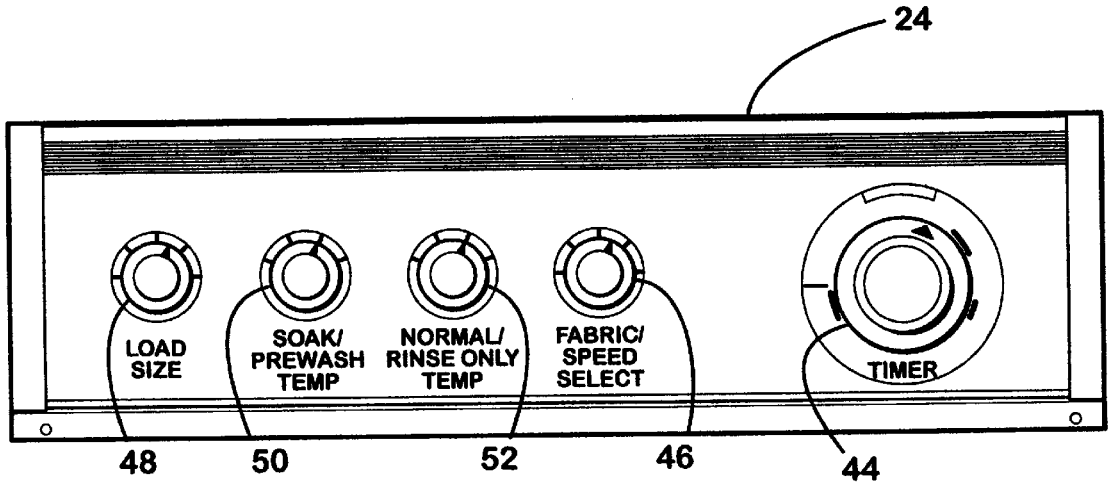
FIG. 2 is a detailed view of the control panel of the automatic washer of FIG. 1 according to the present invention.

FIG. 2 shows the control console 24 in greater detail. A timer knob 44 is provided for allowing the operator to select between a Soak cycle, a Normal cycle and a Rinse&Spin Only cycle. The operator can also control the length of these cycles by the initial timer position at the start of the automatic washer operation. A selector dial 46 is provided for inputting the desired agitate and spin speeds. A load size selector dial 48 is provided for inputting the desired load size.

As described above, by movement of the timer knob 44, the automatic washer 10 may be selectively operated in either a soak cycle, a normal cycle or a rinse&spin cycle. If a soak cycle is selected, water is supplied into the wash tub according to the load size selected and the clothes are soaked for the selected period of time. The wash liquid is subsequently drained and extracted from the clothes by spinning the wash basket 16. Detergent may be used and the clothes may be periodically agitated for a limited period of time during the soak cycle. If the normal wash cycle is selected, the water is supplied into the wash tub to mix with the detergent placed in the washer. The washer 10 is cycled through a wash routine including agitating the clothes, draining the wash liquid and subsequently rinsing the clothes a predetermined number of times as further described herein below.

According to the present invention, the temperature of the supplied wash liquid may be independently controlled for the soak and normal wash cycle. By providing separate soak and normal wash cycles with independent temperature control, the temperatures of wash liquid during the normal wash cycle may be controlled to lower temperatures than previously considered acceptable in the automatic washer industry. This can be accomplished because if an uncontrolled hot or high temperature wash is required, the user of the automatic washer can select a high temperature soak cycle prior to the normal wash cycle. However, by only providing a high temperature wash through use of the soak cycle selection, the present invention ensures that the user or operator of the automatic washer carefully considers whether the hot water wash is actually necessary. In this manner, the present invention will result in a hot water wash being selected less often than with conventional controls.

As shown in FIG. 2, a soak temperature dial 50 is provided for inputting the desired wash liquid temperature during the Soak cycle. By use of the soak temperature dial 50, the temperature of the wash liquid supplied into the tub may be varied between a HOT (approximately 140° F.), a WARM (approximately 95° F.) and a COLD (approximately 60° F.) selection. When a HOT fill is selected, the valves 34 and 36 are controlled to supply an uncontrolled hot water fill wherein the hot water valve 34 is fully on and the cold water valve 36 is fully off. When a WARM fill is selected, both the valves 34 and 36 are fully on. When a COLD fill is selected, the cold water valve 36 is fully on and the hot water valve is fully off.

A normal temperature dial 52 is provided for inputting the desired wash liquid temperature during the normal wash and rinse cycle. By use of the normal temperature dial 52, the temperature of the wash liquid supplied into the wash tub may be varied between four settings: (1) 100° F. wash/cold rinse; (2) 75° F. wash/75° F. rinse; (3) 75° F. wash/cold rinse; and cold wash/cold rinse. When the 100° F. wash is selected, the mixing valves are controlled via a water temperature sensing and control circuit such that the supplied wash liquid is delivered into the wash tub 18 at 100° F. +/−10° F. U.S. Pat. No. 4,643,350, to DeSchaaf et al., is an example of a water temperature control system for an automatic washer and is hereby incorporated by reference. When the 75° F. wash is selected, the mixing valves 34 and 36 are controlled to supply wash liquid at 75° F. +/−5° F. When the cold wash is selected, the mixing valves are controlled such that the cold water valve 36 is fully on and the hot water valve is fully off.

Figure 3:
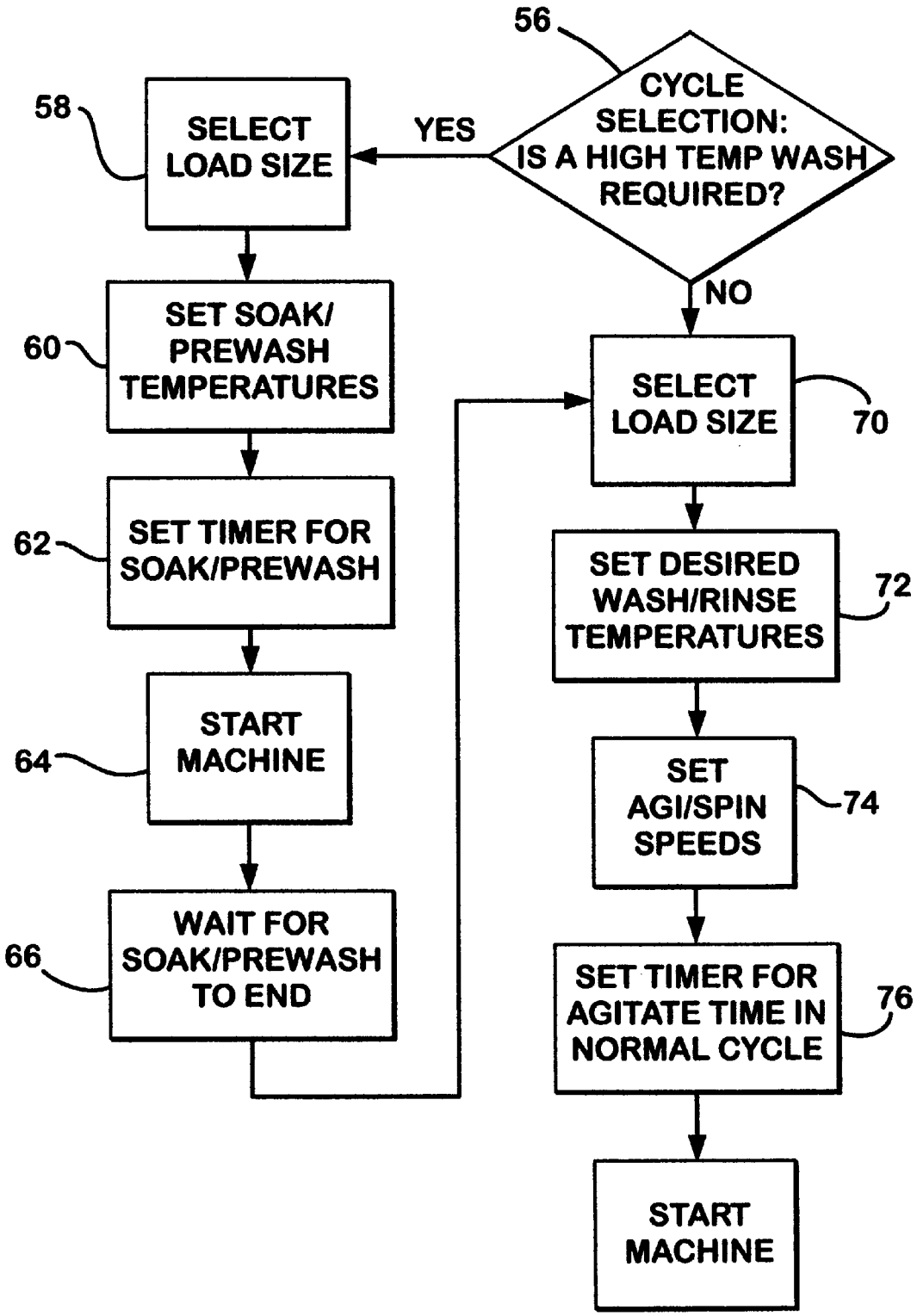
FIG. 3 is a flow chart illustrating the operation of an automatic washer as shown in FIG. 1 according to the present invention.

FIG. 3 is a flow chart illustrating the wash process of the present invention. The first action, shown in step 56, is for the user to make a cycle selection. This decision is driven in part by a determination of whether a high temperature wash is required to adequately wash the intended clothes items. If a high temperature wash is necessary, the user selects the load size using the load size knob 48 and the high temperature soak cycle using the timer knob 44 and the soak temperature dial 50, as shown in steps 58, 60, 62 and 64. During a high temperature soak cycle, shown as step 66, the wash tub 18 is filled with HOT water and the clothes soak with intermittent agitation. Detergent is preferably added to the clothes load. The wash liquid is then drained from the wash tub 18 and the basket 16 is spun to extract wash liquid from the clothes.

After the soak cycle is complete, the clothes may be washed in a normal wash cycle or, alternatively, a normal wash cycle may be initially selected, bypassing the soak cycle, if the clothes do not need a high temperature wash. As shown in steps 70, 72, 74 and 76 the user selects the load size, sets the desired wash/rinse temperatures, sets the desired agitate/spin speeds and selects the amount of desired agitate time in the normal cycle. As described above, the maximum temperature option during the normal wash cycle is 100° F. +/−10° F.

Figure 4:
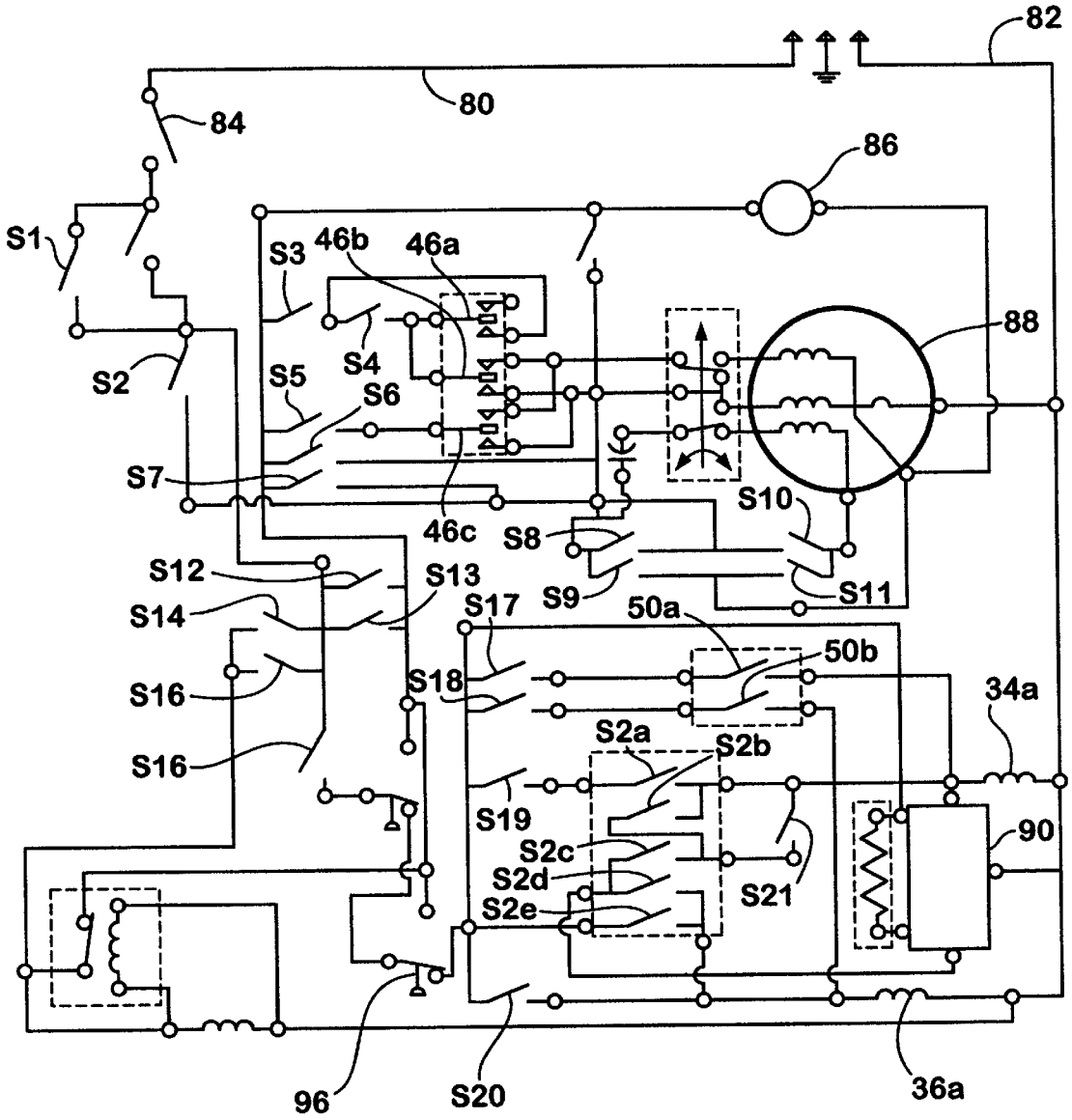
FIG. 4 is an electrical schematic view of the control components of the present invention.

FIG. 4 is a schematic illustration of the control components of the present invention. The control components are energized through power supply lines 80 and 82. A push/pull switch 84, associated with the timer knob 44 operates to supply power the washer components. A timer motor 86, associated with the timer knob 44, drives a plurality of timer cam operates switches S1–S21, as is well known, for operating the automatic washer though the selected cycle. A drive motor 88 is provided for selectively driving the agitator 17 and the wash basket 16.

The speed selector dial 46 is associated with a plurality of switches 46*a*, 46*b*, and 46*c* for controlling motor speed. The soak cycle temperature selector dial 50 is associated with a plurality of switches 50*a* and 50*b* for energizing the mixing valve coils 34*a* and 36*a*. The normal wash temperature selector dial 52 is operatively associated with a plurality of switches 52*a*–52*e*. An electronic circuit 90 is provided for controlling the temperature of the inlet water during the normal wash cycle as described above.

In addition to conserving energy by reducing the wash liquid temperature during normal wash, the present invention is directed to a wash system which also uses less water. This is accomplished by utilizing a spray rinse system for rinsing the clothes items after they have been washed with detergent. The spray rinse process of the present invention is similar to the spray rinse process for an automatic washer which is disclosed in U.S. Pat. No. 5,167,722, which is herein incorporated by reference.

Figure 5:
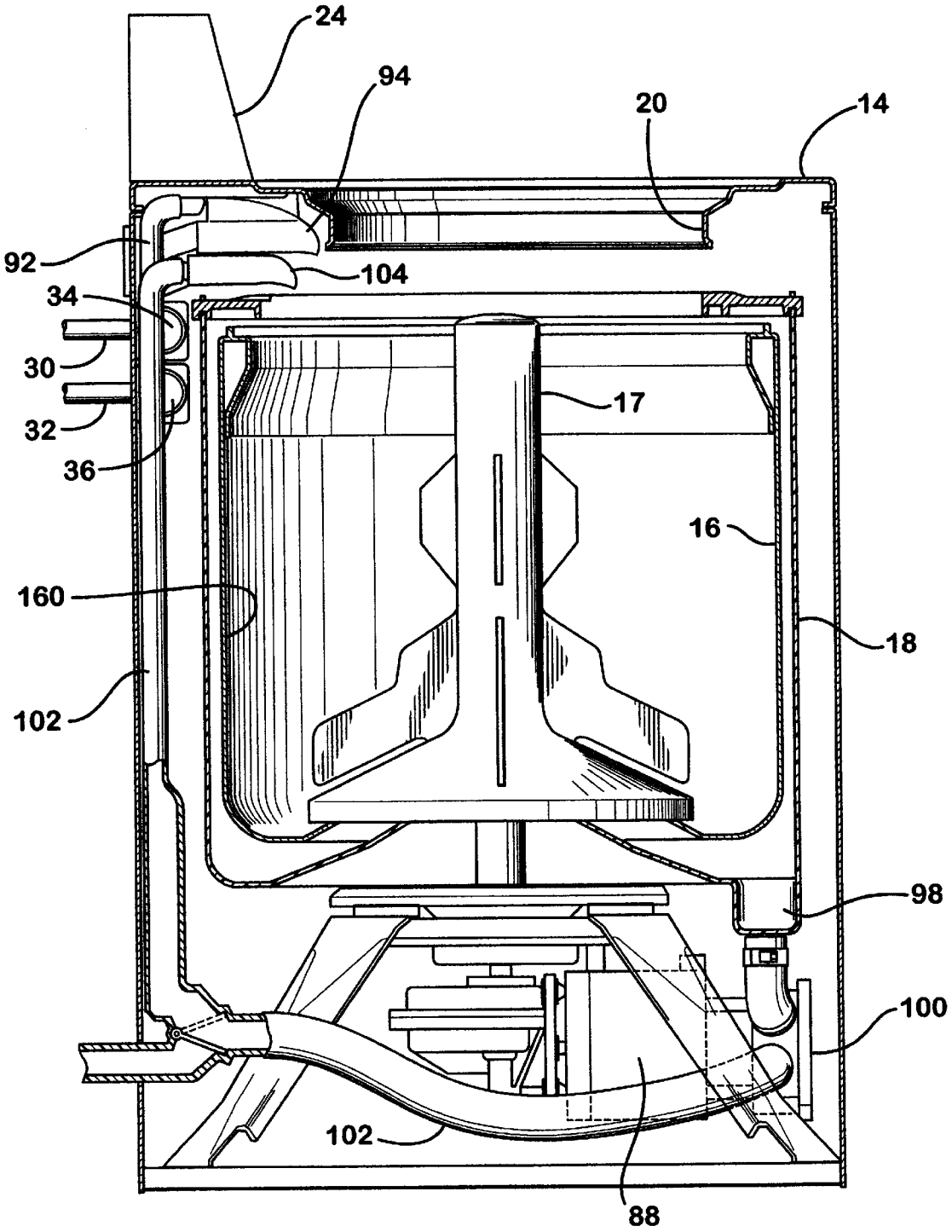
FIG. 5 is a schematic illustration of the fluid conduits and spray nozzles of the present invention.

As shown in FIG. 5, incoming fresh water is directed through the valves 34 and 36, in accordance with the temperature selection, and flows through conduit 92 and is sprayed into the wash basket 16 through a spray nozzle 94. During a typical deep fill, water is sprayed into the wash basket 16 until the liquid level rises to completely submerge the clothes placed within the wash basket. After a deep fill wash step has occurred, the clothes are rinsed using a spray rinse process or cycle. The spray rinse cycle comprises a plurality of rinse steps. During a spray rinse step, only a relatively small amount of water is inlet into the wash basket. For example, less than two gallons is sufficient with approximately one gallon being the preferred amount of rinse liquid. The amount of wash liquid is controlled by a pressure sensor 96 (see FIG. 4) which is located in the sump 98 of the wash tub 18. The pressure switch 96 opens when a predetermined amount of wash liquid has been supplied into the wash tub 18. Thereby deenergizing the water valves 34 and 36.

While the rinse liquid is being supplied, or alternatively after the rinse liquid is supplied, the motor 88 spins the wash basket 16 such that the clothes within the wash basket are held against the peripheral wall 16*a* of the wash basket 16. While the basket is spinning, the supplied rinse liquid is recirculated by a pump 100 from the sump 98, through a conduit 102 and sprayed onto the spinning clothes through a spray nozzle 104. The rinse liquid is recirculated over and through the clothes for approximately two minutes. The rinse liquid is then sent to drain and another rinse step is performed. Preferably, six spray rinse steps are performed to achieve thorough rinsing. The number and the length of the spray rinse steps is controlled by the timer motor and related cam switches which are used to control the operation of the mixing valves 34 and 36, the drive motor 88 and the pump 100.

By employing the above described spray rinse process or cycle, the amount of water used during a wash cycle can be substantially reduced. For example, where a typical automatic washer may use over 40 gallons of water for a complete cycle, a washer employing a spray rinse process may use less than 30 gallons of water. This represents a more than 25% water savings per cycle.

It can be seen, therefore, that the present invention provides an automatic washer which will result in substantial reduction in the consumption of water and energy. Energy will be saved by preventing the user from over selecting a high temperature wash. The unique control scheme of the present washer forces the user to carefully consider whether a high temperature wash is necessary and to only select a high temperature soak cycle when absolutely necessary. Moreover, water is saved by employing a plurality of recirculating spray rinse steps.

Although the present invention has been described with reference to a specific, those of skill in the Art will recognize that changes may be made thereto without departing from the scope and spirit of the invention as set forth in the appended claims. It should be understood, therefore, that we wish to embody within the scope of the patent warranted hereon all such modifications as reasonably and properly come within the scope of our contribution to the art.

What is claimed is:

1. An automatic washer having a wash basket disposed within a tub to receive a load of clothes to be washed, the automatic washer including an automatic liquid temperature control system comprising:

a switch for selecting between a normal wash cycle and a soak cycle;

a switch for selecting a desired wash water temperature in the soak cycle; and a switch for selecting a desired wash water temperature during the normal wash water cycle, the temperature selection means for the normal cycle being independent from the temperature selection means for the soak cycle, wherein the temperature selection switch for the normal cycle limits the maximum temperature setting during the normal wash to less than the maximum temperature setting for the soak cycle.

2. The automatic washer according to claim 1 further having hot and cold inlet valves connected to respective sources of hot and cold water and wherein the temperature selection switch for the soak cycle provides for the selection of an uncontrolled hot water fill wherein the hot water valve is fully open and the cold water valve is closed.

3. The automatic washer according to claim 2, further wherein the temperature selection switch for the normal wash cycle provides for a maximum wash liquid temperature of 110° F.

4. The automatic washer according to claim 3, further wherein the temperature selection switch for the normal wash cycle provides for a maximum rinse liquid temperature of 80° F.

5. The automatic washer according to claim 1 further having hot and cold inlet valves connected to respective sources of hot and cold water and wherein the temperature selection switch for the soak cycle provides for selection between supplying a HOT, WARM and COLD fill wherein the HOT fill is an uncontrolled hot water fill with the hot water valve being fully open and the cold water valve being closed, the WARM fill is a mixed hot and cold water fill wherein both the hot and cold water valves are fully open and a combined flow of water from the valves is supplied into the tub and the COLD fill is an uncontrolled cold water fill wherein the cold water valve is fully open and the hot water valve is closed.

6. The automatic washer according to claim 5, further wherein the temperature selection switch for the normal wash cycle provides for a selection between a 100° F. high temperature wash +/−10° F., a 75° F. medium temperature wash +/−5° F. and an uncontrolled cold water wash.

7. The automatic washer according to claim 6, further wherein the temperature selection switch for the normal wash cycle provides for a selection between a 75° F. medium temperature rinse and an uncontrolled cold water rinse.

8. An automatic washer having a rotatable wash basket for receiving a wash load, the wash basket having a peripheral wall disposed within a wash tub, the automatic washer comprising:

a temperature control system including:

means for selecting between a normal wash cycle and a soak cycle, means for selecting a desired wash water temperature in the soak cycle, and means for selecting a desired wash water temperature during the normal wash water cycle, the temperature selection means for the normal cycle being independent from the temperature selection means for the soak cycle, wherein the temperature selection means for the normal cycle limits the maximum temperature setting during the normal wash to less than the maximum temperature setting for the soak cycle; and a spray rinse system including:

a nozzle, a recirculation conduit connected to the nozzle, a means for rotating the wash basket at a speed sufficient to maintain the wash load against the peripheral wall, and a wash pump connected to the recirculation conduit for drawing wash liquid from the bottom of the wash tub and spraying it out through the nozzle onto the rotating wash load clothes disposed within the wash basket.

9. The automatic washer according to claim 8 further having hot and cold inlet valves connected to respective sources of hot and cold water and wherein the temperature selection means for the soak cycle provides for the selection of an uncontrolled hot water fill wherein the hot water valve is fully open and the cold water valve is closed.

10. The automatic washer according to claim 9, further wherein the temperature selection means for the normal wash cycle provides for a maximum wash liquid temperature of 110° F.

11. The automatic washer according to claim 10, further wherein the temperature selection means for the normal wash cycle provides for a maximum rinse liquid temperature of 80° F.

12. The automatic washer according to claim 8 further having hot and cold inlet valves connected to respective sources of hot and cold water and wherein the temperature selection means for the soak cycle provides for selection between supplying a HOT, WARM and COLD fill wherein the HOT fill is an uncontrolled hot water fill with the hot water valve being fully open and the cold water valve being closed, the WARM fill is a mixed hot and cold water fill wherein both the hot and cold water valves are fully open and a combined flow of water from the valves is supplied into the tub and the COLD fill is an uncontrolled cold water fill wherein the cold water valve is fully open and the hot water valve is closed.

13. The automatic washer according to claim 12, further wherein the temperature selection means for the normal wash cycle provides for a selection between a 100° F. high temperature wash +/−10° F., 75° F. medium temperature wash +/−5° F. and an uncontrolled cold water wash.

14. The automatic washer according to claim 13, further wherein the temperature selection means for the normal wash cycle provides for a selection between a 75° F. medium temperature rinse and an uncontrolled cold water rinse.

15. The automatic washer according to claim 8, further comprising:

means for limiting the amount of wash liquid supplied into the wash basket such that the clothes are saturated with rinse liquid but not completely immersed in wash liquid.

16. The automatic washer according to claim 8, further comprising:

means for operating the wash basket through a rinse cycle including a plurality of rinse steps; and means for supplying less than two gallons of wash liquid into the wash basket during each spray rinse step.

17. A method supplying wash liquid into an automatic washer for washing clothes in an automatic washer, the automatic washer having a wash basket disposed within a tub to receive a load of clothes to be washed, the method comprising the steps of:

determining whether a HOT temperature wash cycle is required to properly clean clothes;

selecting a pre-wash cycle if a HOT temperature wash cycle is required;

setting the inlet temperature of the wash liquid for the pre-wash cycle to a HOT temperature;

selecting a normal wash cycle; and setting the inlet temperature of the wash liquid for the normal wash cycle, the temperature selection means for the normal cycle being independent from the temperature selection means for the pre-wash cycle wherein the temperature selection means for the normal cycle limits the maximum temperature setting during the normal wash to less than the HOT temperature setting for the soak cycle.

18. The method of supplying wash liquid into an automatic washer according to claim 17 wherein the HOT temperature wash cycle is an uncontrolled, fully hot water fill and all of the temperature selections for the normal cycle require some use of cold water.

19. The method of supplying wash liquid into an automatic washer according to claim 17, further wherein:

the step of setting the inlet temperature of the wash liquid for the pre-wash cycle requires a selection between supplying a HOT, WARM and COLD fill wherein the HOT fill is an uncontrolled hot water fill with the hot water valve being fully open and the cold water valve being closed, the WARM fill is a mixed hot and cold water fill wherein both the hot and cold water valves are fully open and a combined flow of water from the valves is supplied into the tub and the COLD fill is an uncontrolled cold water fill wherein the cold water valve is fully open and the hot water valve is closed; and the step of setting the inlet temperature of the wash liquid for the normal wash cycle requires a selection between a 100° F. high temperature wash +/−10° F., a 75° F. medium temperature wash +/−5° F. and an uncontrolled cold water wash.

20. The method of supplying wash liquid into an automatic washer according to claim 17, further comprising the steps of:

operating the washer through a rinse cycle including a plurality of rinse steps wherein during each rinse step washing liquid is supplied into the washer and recirculated over the clothes within the basket; and supplying less than two gallons of wash liquid into the washer during each rinse step.

21. An automatic washer having a wash basket disposed within a tub to receive a load of clothes to be washed, the automatic washer including an automatic liquid temperature control system comprising:

means for selecting between a normal wash cycle and a soak cycle;

means for selecting a desired wash water temperature in the soak cycle; and means for selecting a desired wash water temperature during the normal wash water cycle, the temperature selection means for the normal cycle being independent from the temperature selection means for the soak cycle, wherein the temperature selection means for the normal cycle limits the maximum temperature setting during the normal wash to less than the maximum temperature setting for the soak cycle.

22. The automatic washer according to claim 21 further having hot and cold inlet valves connected to respective sources of hot and cold water and wherein the temperature selection means for the soak cycle provides for the selection of an uncontrolled hot water fill wherein the hot water valve is fully open and the cold water valve is closed.

23. The automatic washer according to claim 21, further wherein the temperature selection means for the normal wash cycle provides for a maximum wash liquid temperature of 110° F.

24. The automatic washer according to claim 23, further wherein the temperature selection means for the normal wash cycle provides for a maximum rinse liquid temperature of 80° F.

25. The automatic washer according to claim 21 further having hot and cold inlet valves connected to respective sources of hot and cold water and wherein the temperature selection means for the soak cycle provides for selection between supplying a HOT, WARM and COLD fill wherein the HOT fill is an uncontrolled hot water fill with the hot water valve being fully open and the cold water valve being closed, the WARM fill is a mixed hot and cold water fill wherein both the hot and cold water valves are fully open and a combined flow of water from the valves is supplied into the tub and the COLD fill is an uncontrolled cold water fill wherein the cold water valve is fully open and the hot water valve is closed.

26. The automatic washer according to claim 25, further wherein the temperature selection means for the normal wash cycle provides for a selection between a 100° F. high temperature wash +/−10° F., 75° F. medium temperature wash +/−5° F. and an uncontrolled cold water wash.

27. The automatic washer according to claim 26, further wherein the temperature selection means for the normal wash cycle provides for a selection between a 75° F. medium temperature rinse and an uncontrolled, cold temperature rinse.

* * * * *